US011244580B2

(12) United States Patent
Mehta

(10) Patent No.: US 11,244,580 B2
(45) Date of Patent: Feb. 8, 2022

(54) SEAL ASSEMBLY

(71) Applicant: SURELOCK PLASTICS PVT. LTD., Maharashtra (IN)

(72) Inventor: Kaushal Mehta, Mumbai (IN)

(73) Assignee: SURELOCK PLASTICS PVT. LTD., Mumbai (IN)

( * ) Notice: Subject to any disclaimer, the term of this patent is extended or adjusted under 35 U.S.C. 154(b) by 637 days.

(21) Appl. No.: 16/091,931

(22) PCT Filed: Apr. 5, 2017

(86) PCT No.: PCT/IN2017/050132
§ 371 (c)(1),
(2) Date: Oct. 5, 2018

(87) PCT Pub. No.: WO2017/175245
PCT Pub. Date: Oct. 12, 2017

(65) Prior Publication Data

US 2019/0122590 A1 Apr. 25, 2019

(30) Foreign Application Priority Data

Apr. 5, 2016 (IN) ..... 201621012019

(51) Int. Cl.
*G09F 3/03* (2006.01)

(52) U.S. Cl.
CPC ..... *G09F 3/037* (2013.01)

(58) Field of Classification Search
CPC . G09F 3/037; G09F 3/14; B65D 63/10; F16B 2/02
See application file for complete search history.

(56) References Cited

U.S. PATENT DOCUMENTS

| | | | | |
|---|---|---|---|---|
| 4,902,055 | A * | 2/1990 | Scott | B65D 77/185 292/319 |
| 5,945,909 | A * | 8/1999 | Kolton | G09F 3/0352 340/572.1 |
| 6,328,356 | B1 * | 12/2001 | Aichmann | G09F 3/037 24/30.5 P |
| 9,171,486 | B1 * | 10/2015 | Anderton | G09F 3/037 |
| 2005/0001041 | A1 * | 1/2005 | McCarthy | G09F 3/0335 235/492 |
| 2012/0042482 | A1 * | 2/2012 | Koh | G09F 3/037 24/16 PB |

FOREIGN PATENT DOCUMENTS

| | | | |
|---|---|---|---|
| EP | 1 768 080 | A1 | 3/2007 |
| FR | 2 991 406 | A1 | 12/2013 |
| WO | 03/014609 | A2 | 2/2003 |
| WO | 2014/107819 | A1 | 7/2014 |

* cited by examiner

*Primary Examiner* — David M Upchurch
(74) *Attorney, Agent, or Firm* — Maschoff Brennan

(57) ABSTRACT

A seal assembly includes a first component housing molded on a first component. The first component housing has at least two oppositely facing first component vertical openings. A plurality of locking grooves are defined on a lower surface of the first component housing. The seal assembly further includes a second component housing molded on a second component. The second component housing adapts into a tail element emerging from the second component housing. The tail element slides through the at least two oppositely facing first component vertical openings to urge the second component housing inside the first component housing.

12 Claims, 10 Drawing Sheets

SEAL ASSEMBLY

RELATED APPLICATION

This application is related to, and claims priority from the Indian provisional Patent Applications No. 201621012019 filed on 5 Apr. 2016 which is hereby incorporated in its entirety by reference.

TECHNICAL FIELD OF THE INVENTION

The present invention relates to a metal lock security seals, and more particularly to a seal assembly.

BACKGROUND OF THE PRESENT INVENTION

A metal lock security seal is used to tie, bind or secure articles together and also for avoiding unauthorised access or theft of the secured articles. Currently known metal lock security seals are made up of parts which are fixed together by ultrasonic welding. Fixing the various parts by known means however does not provide expected safety and security to the secured articles, as such seals can be tampered very easily. Moreover, tampering of such seals is usually done by cutting and opening the seal along the weld areas. Thereafter, the cut and open areas can be resealed by any suitable hot process, which shows the low levels of safety and security associated with such seals from the prior art. Many times, the seal is tampered in a manner such that the tampering is not identifiable by a plain visual inspection.

The published Indian Patent Application No. 2843/MUM/2014 discloses an improved security seal providing security. This improved security seal comprises a plastic strip (i.e. a strap), a hollow cap or disc (i.e. a strap head housing), all in a single piece, and a flat stainless steel spring or a metallic insert. The hollow cap or disc in the Application No. 2843/MUM/2014 holds the flat stainless steel spring or the metallic insert to provide a secure grip to the plastic strip when the plastic strip is inserted through the flat stainless steel spring or the metallic insert held inside the hollow cap or disc. However again, the security seal as claimed in Application No. 2843/MUM/2014 exhibit low level of security and safety as tampering is possible by damaging the cap or disc, thereby easily breaking the strap head housing, and the entire seal thereby.

In view of these forthcoming drawbacks in the prior art, there is a need for an assembly or an implement having a technical advance such that the tampering is not possible. Moreover, there is need for a technically advanced seal assembly in which it will be easy to identify that an attempt to tamper with the seal has been made by plain visual inspection.

BRIEF SUMMARY OF THE PRESENT INVENTION

The abovementioned drawbacks seen in the prior art are obviated by providing a seal assembly having two components. The two components are assembled together to form the seal assembly, as per an embodiment of the present invention. The seal assembly comprises provisions for locking the two components in a tamper proof manner. As it shall be appreciated, the seal assembly as per an embodiment of the present invention has tamper proof capabilities, such that any attempt to tamper the same can be detected by a plain visual inspection. Further, even if the seal assembly as per an embodiment of the present invention is tampered, then the seal assembly cannot be reassembled by a hot process or a permanent fixing process.

The seal assembly as per an embodiment of the present invention comprises a first component housing molded on a first component, the first component housing has at least two oppositely facing first component vertical openings, wherein a plurality of locking grooves are defined on a lower surface of the first component housing; a second component housing molded on a second component, the second component housing adapts into a tail element emerging from the second component housing; wherein a plurality of protrusions are provided on a lower face of the second component housing; and wherein at least one locking device extends from the second component housing; and wherein the tail element slides through the at least two oppositely facing first component vertical openings to urge the second component housing inside the first component housing for simultaneously allowing the plurality of protrusions to lockingly engage with the plurality of locking grooves along with the at least one locking device to engage with a wall adjoining the first component vertical openings.

BRIEF DESCRIPTION OF THE DRAWINGS

Reference will be made to embodiments of the present invention, examples of which may be illustrated in the accompanying figures. These figures are intended to be illustrative, not limiting. Although the present invention is generally described in the context of these embodiments, it should be understood that it is not intended to limit the scope of the present invention to these particular embodiments.

DETAILED DESCRIPTION OF THE PRESENT INVENTION

In general, the present invention describes a seal assembly having two components. The two components are assembled together to form the seal assembly, as per an embodiment of the present invention. The seal assembly comprises provisions for locking the two components in a tamper proof manner.

Figure 1:
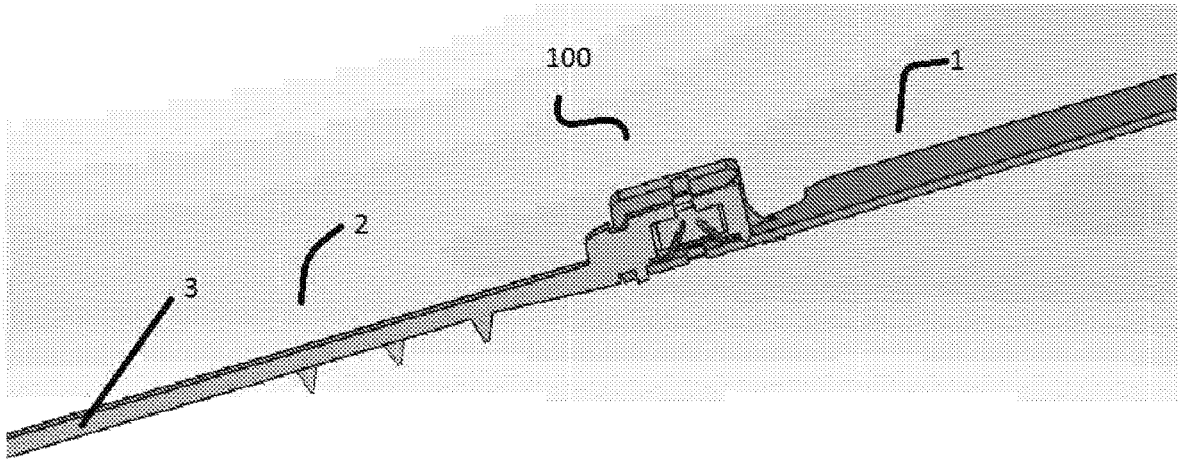
FIG. 1 shows a perspective view of a seal assembly, as per an embodiment of the present invention.

The accompanying FIG. 1 shows a seal assembly (100) as per an embodiment of the present invention in a perspective view. As seen in FIG. 1, the seal assembly (100) comprises two components, i.e. a first component (1) and a second component (2), which are assembled with each other to form the seal assembly (100). The second component (2) adapts into a tail element (3). It shall be understood by a person skilled in the art that the seal assembly (100) as per an embodiment of the present invention can be formed by various materials such as thermoplastic, plastic, metal, or any other preferable material, either alone or in a combination thereof.

Figure 2:
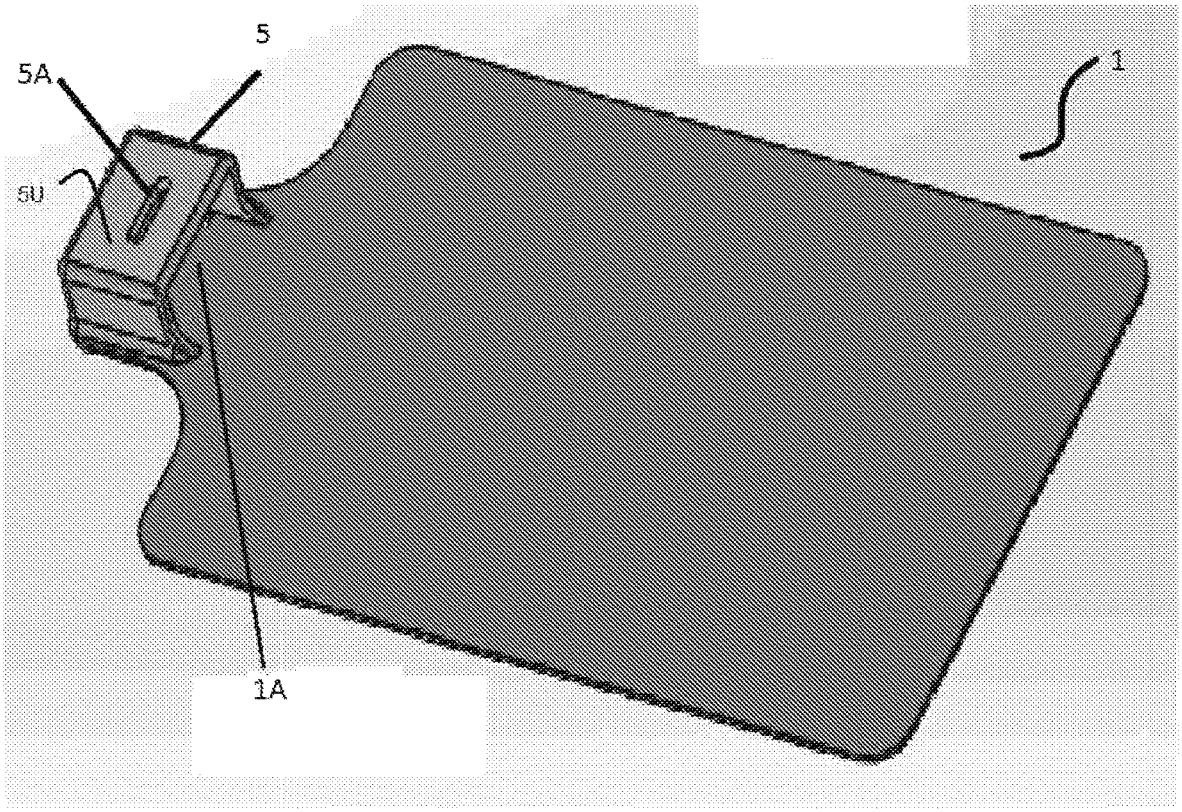
FIGS. 2-4 shows a first component of a seal assembly in various perspective views, as per an embodiment of the present invention.
Figure 3:
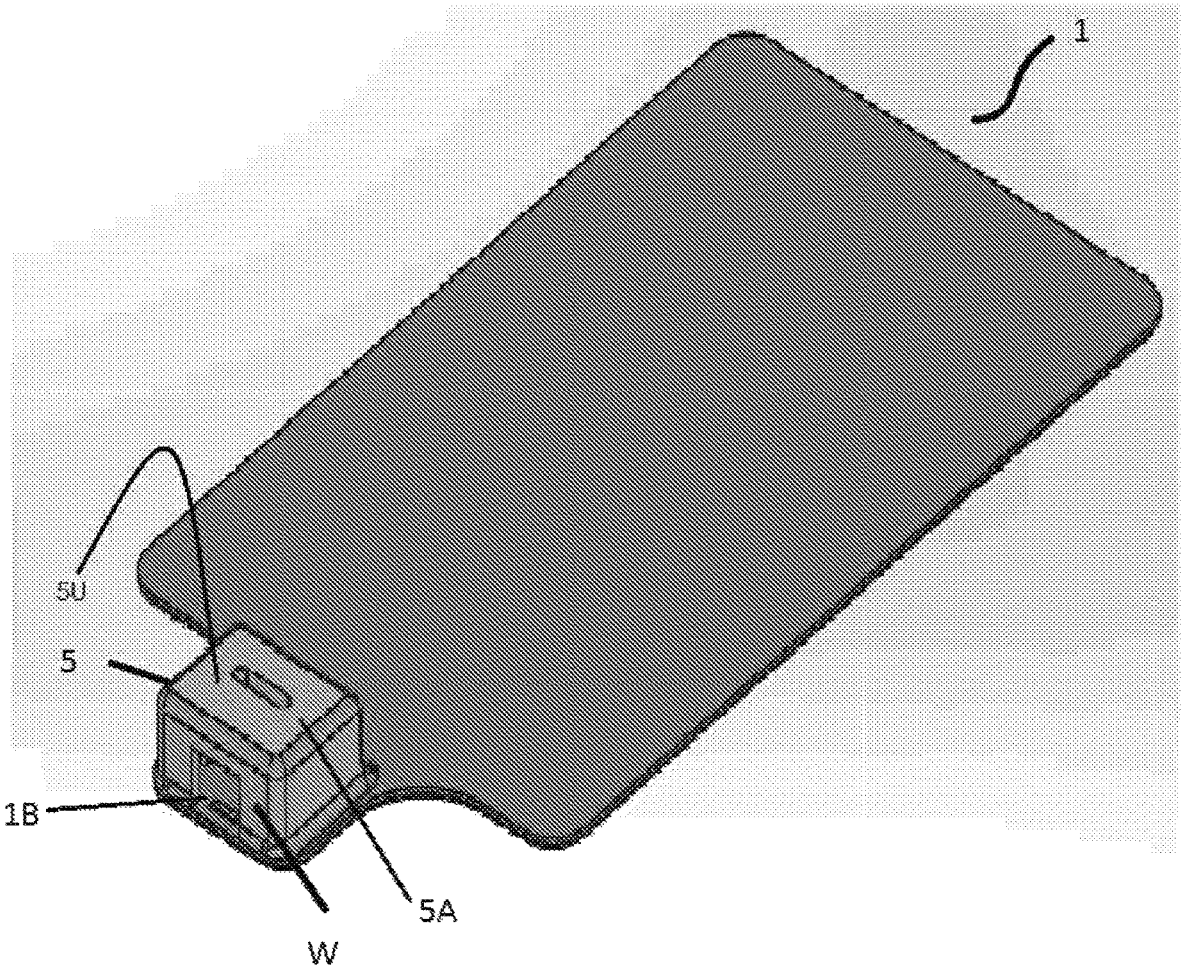
Figure 4:
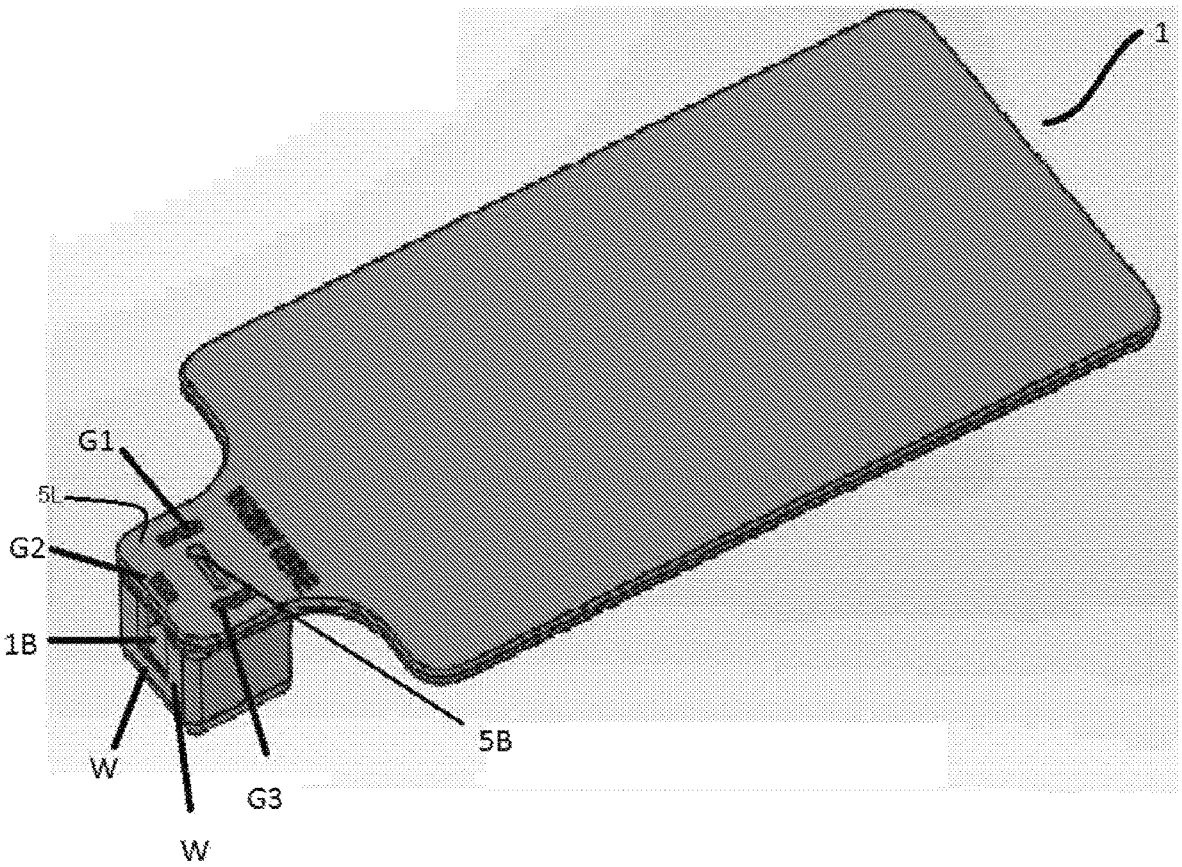

The accompanying FIGS. 2-4 shows the first component (1) of the seal assembly (100) as per embodiments of the present invention, in various perspective views. As seen in FIGS. 2-4, a first component housing (5) is molded on the first component (1). The first component housing (5) has oppositely facing vertical openings (1A, 1B). As seen in FIGS. 2-4, the first component housing has an upper face (5U) and a lower face (5L). The first component housing (5) further has first component apertures (5A, 5B) coaxially defined on the upper face (5U) and lower face (5L). As seen in FIGS. 3 and 4, a wall (W) is defined on the first component housing, the wall (W) is adjoining the vertical opening (1B). As seen in FIG. 4, a plurality of locking grooves (G1, G2, G3) are defined on the lower face (5L) of the first component housing (5). In a preferred embodiment of the present invention, at least two oppositely facing vertical openings (1A, 1B), at least two coaxially defined first component apertures (5A, 5B), and at least three locking grooves (G1, G2, G3) are defined on the first component housing (5). In a preferred embodiment of the present invention, the wall (W) is defined close to the one of the oppositely facing vertical opening (1B). However, it shall be clear to a person skilled in the art that the wall (W) may also be defined close the other vertical opening (1A) on the opposite side of the vertical opening (1B).

Figure 5:
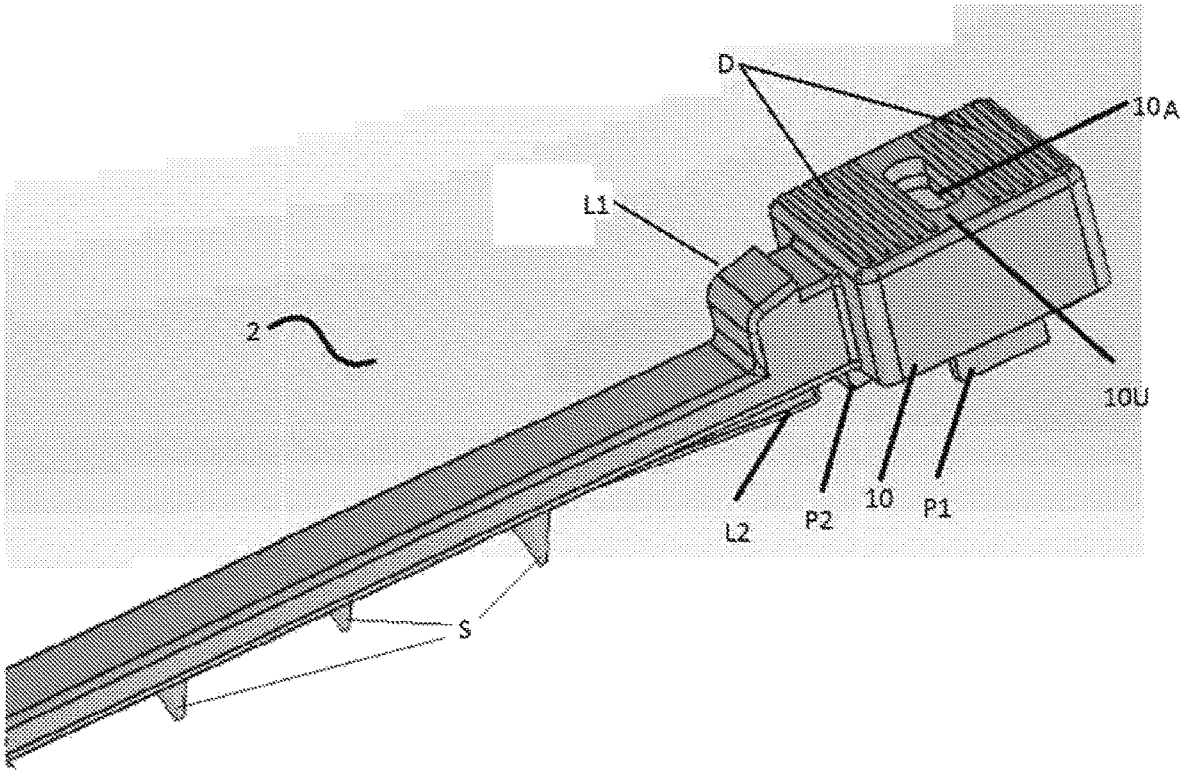
FIGS. 5-6 shows a second component of a seal assembly in various perspective views, as per an embodiment of the present invention.
Figure 6:
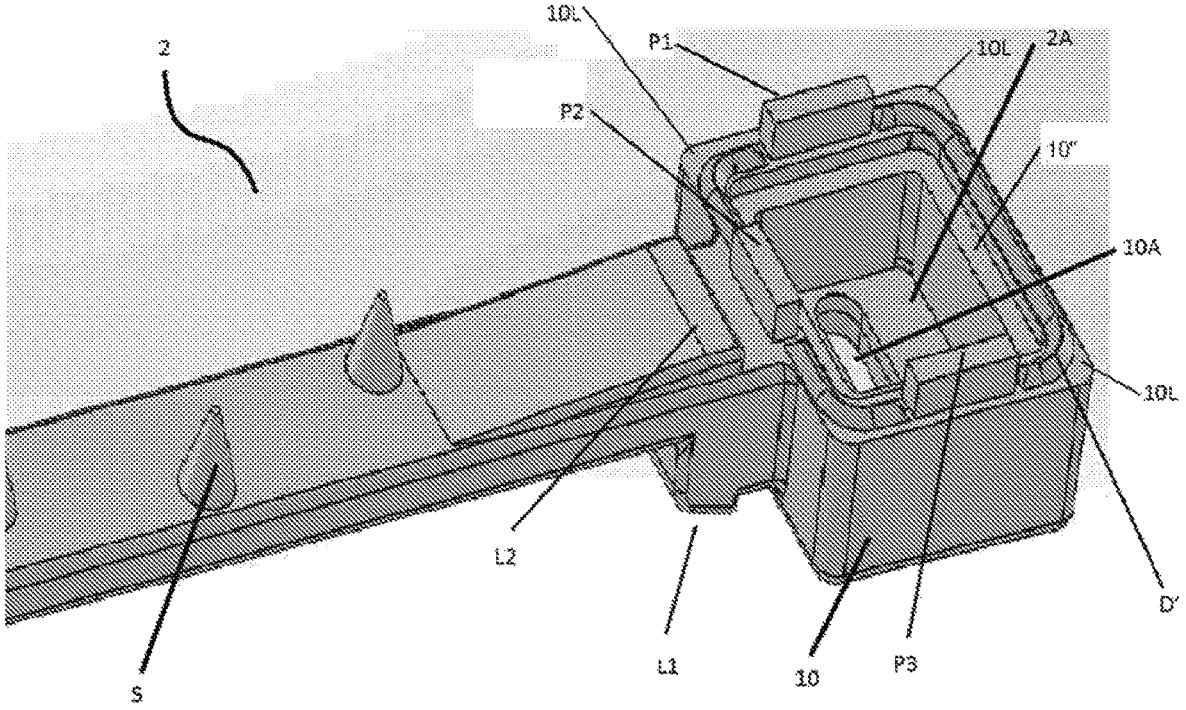

The accompanying FIGS. 5 and 6 shows the second component (2) of the seal assembly (100) as per embodiments of the present invention, in various perspective views. As seen in FIG. 5 a second component housing (10) is molded on the second component (2). As seen in FIGS. 5 and 6, protrusions (P1, P2, P3) are provided on a lower surface (10L) of the second component housing (10). Further, locking devices (L1, L2) are defined over the lateral surface of the tail element (3) such that the locking devices (L1, L2) extends from the second component housing (10). In a preferred embodiment of the present invention, two locking devices (L1, L2) are defined on upper and lower lateral surfaces of the tail element (3). However, it shall be understood by a person skilled in the art that the locking devices (L1, L2) can be defined on both edges of the tail element (3) and extending from the second component housing (10). It shall be further clear to a person skilled in the art that the locking devices (L1, L2) can be provided on any of the vertical faces of the second component housing (10) or both edges of the tail element (3), and not just on the upper and lower lateral surfaces of the tail element (3) close to the second component housing (10) as provided in an embodiment of the present invention that is seen in FIGS. 5 and 6.

As further seen in FIGS. 5 and 6, a second component aperture (10A) is provided on an upper surface (10U) of the second component housing (10). A second component opening (2A) is provided on the lower surface (10L) of the second component housing (10), as seen in FIG. 6. A seat (10") is provided on inside of the second component opening (2A). As seen in FIG. 5 again, a plurality of corrugated substrate lines (D) are defined on the upper surface (10U) of the second component housing (10). Also, substrate lines (D') are provided on the lower surface (10L) of second component housing (10), as again seen in FIG. 6. A plurality of spikes (S) are provided at predetermined distances from the second component housing (10). In a preferred embodiment of the present invention, at least three spikes (3) are defined on the lateral surface of the tail element (3). However, it shall be understood by a person skilled in the art that the spikes (S) can be provided on one or both the edges of the tail element (3), at predetermined distances from the second component housing (10).

Figure 7:
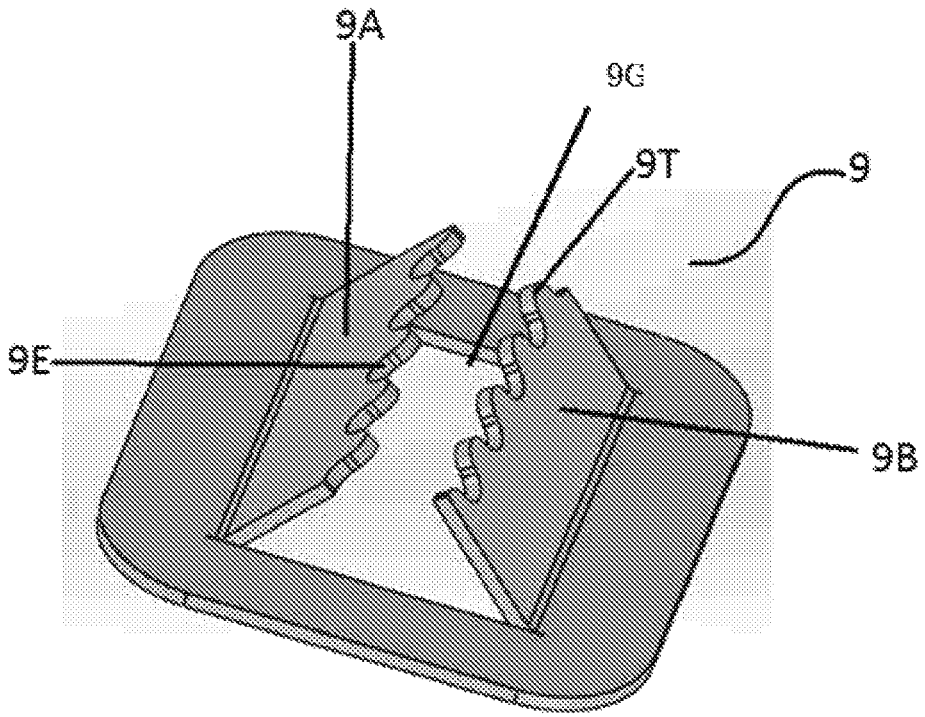
FIGS. 7-8 show perspective views of a metal insert, as per an embodiment of the present invention.
Figure 8:
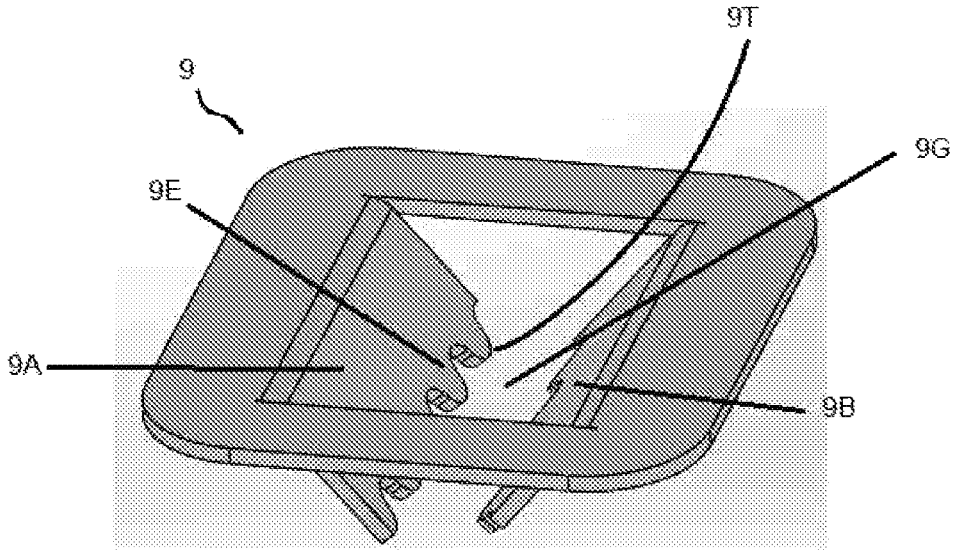

The accompanying FIGS. 7 and 8 show perspective views of a metal insert (9), as per an embodiment of the present invention. The metal insert (9) is provided with projections (9A, 9B). Each projection (9A, 9B) has an edge (9E), and each edge (9E) defines a plurality of teeth (9T). As seen in FIGS. 7 and 8, the projections (9A, 9B) are positioned in such manner, so as to define a gap (9G) between the edges (9E) of each projection (9A, 9B). In a preferred embodiment of the present invention, two projections (9A, 9B) are provided in the metal insert (9). However, it shall be clear to a person skilled in the art that more than two protrusions can also be provided therein.

Again, as seen in FIG. 6 the metal insert (9) is positioned on the seat (10") inside the second component opening (2A) of the second component (2). Thereafter, the second component (2), and more particularly the tail element (3) is slidingly inserted through one of the oppositely facing vertical opening (1A) of the first component (1).

Figure 9:
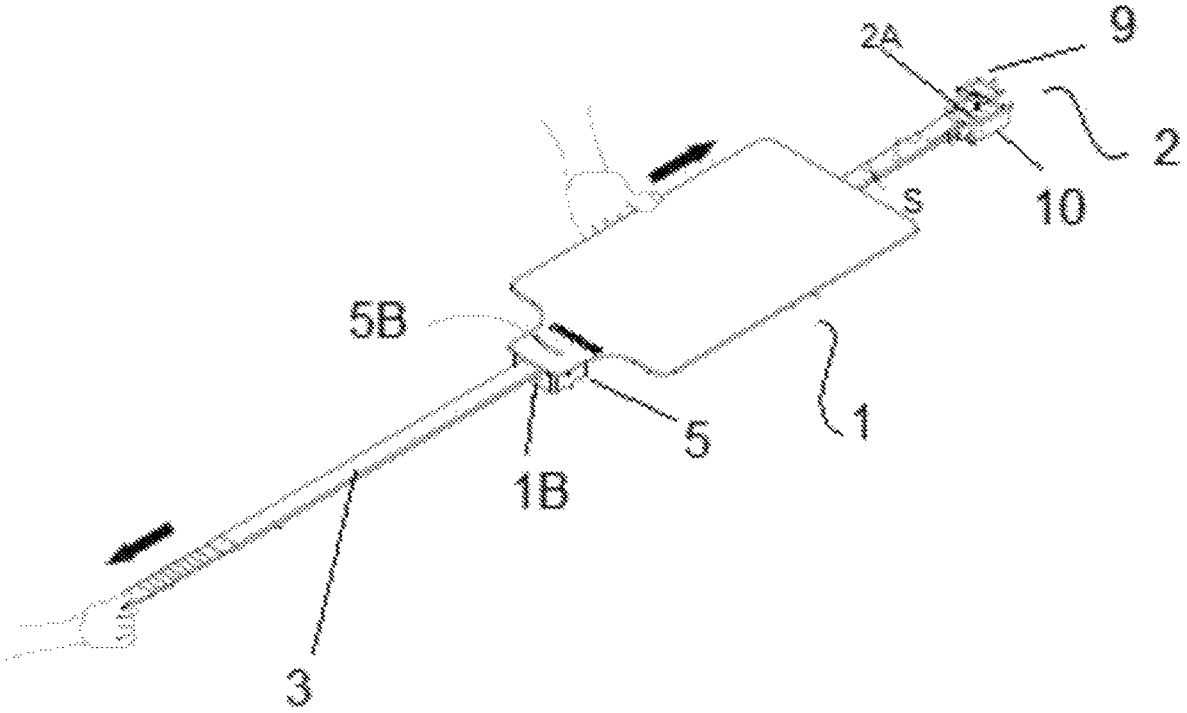
FIG. 9 shows a perspective view during formation of a seal assembly, as per an embodiment of the present invention.

The accompanying FIG. 9 shows a perspective view during formation of a seal assembly (100), as per an embodiment of the present invention. As seen in FIG. 9, the metal insert (9) is placed on the seat (10") that is provided inside the second component opening (2A). Further, the tail element (3) is coming out of the other oppositely facing vertical opening (1B) of the first component (1), as also seen in FIG. 9. As the tail element (3) is being slid and inserted through the oppositely facing vertical openings (1A, 1B), the spikes (S) engage with the first component housing (5), and therefore obstruct further movement of the tail element (3) therethrough. Effectively, a function of the spikes (S) is to provide an indication to the user regarding a position of the second component housing (10) while it is being slid and urged towards the first component housing (5). For this purpose, the spikes (S) are provided at the predetermined distances from the second component housing (10) in a preferred embodiment of the present invention. As a preferred embodiment of the present invention has three spikes (S), a user has at least three chances to decide whether to stop or continue with the locking of the first component with the second component (2). However, any number of spikes (S) can be implemented for this purpose, as shall be understood by a person skilled in the art. In yet another preferred embodiment of the present invention, the tail element (3) is pulled by hand to urge the second component housing (10) towards and inside the first component housing (5). However, it shall be understood by a person skilled in the art that the tail element (3) can also be pulled by a machine, a special apparatus designed for the purpose or any other favourable manual or non-manual means.

Figure 10:
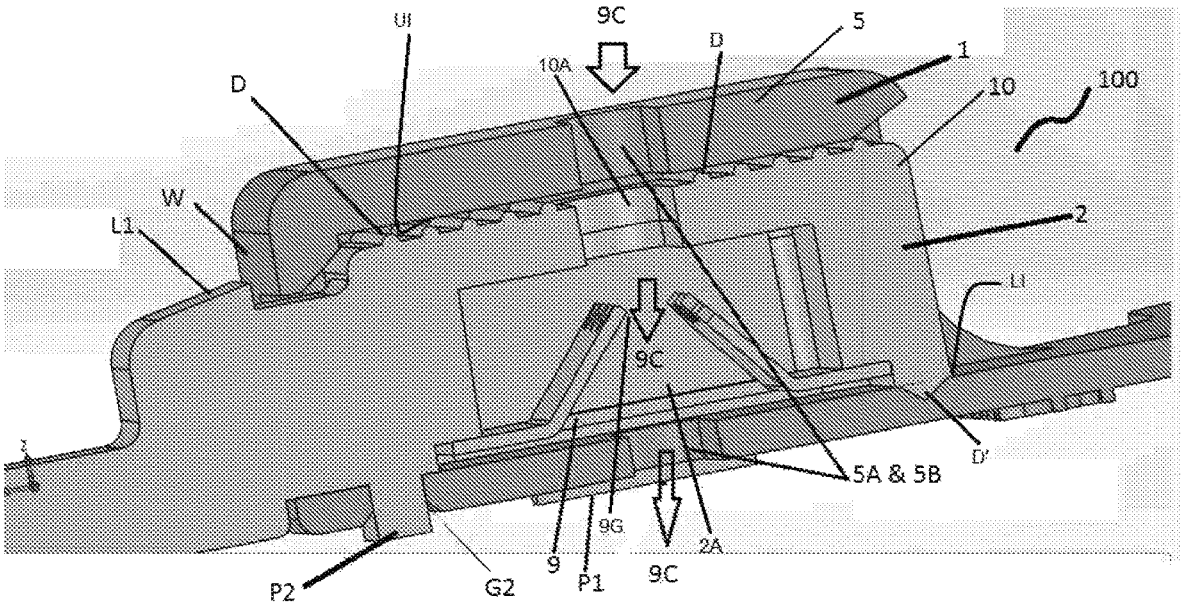
FIGS. 10-11 shows a seal assembly in various cut open perspective views, as per an embodiment of the present invention.
Figure 11:
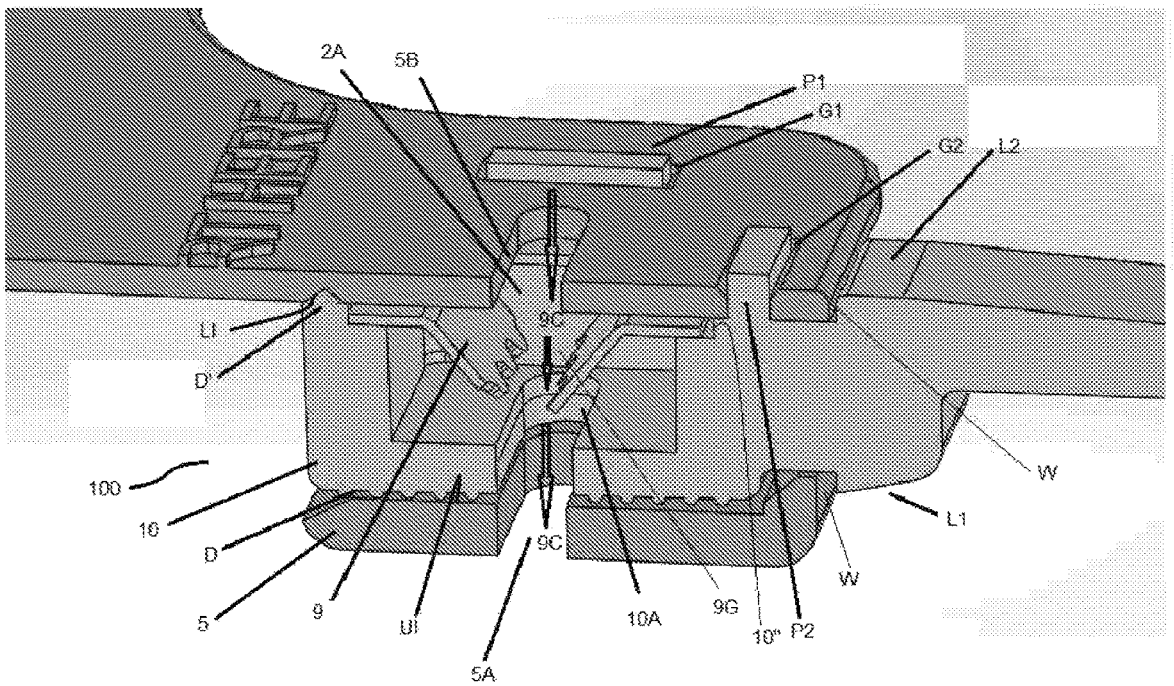

The accompanying FIGS. 10 and 11 shows a seal assembly in various cut open perspective views, as per an embodiment of the present invention. As seen in FIGS. 10 and 11, the second component housing (10) is slidingly inserted inside the first component housing (5). Thereafter, the plurality of protrusions (P1, P2, P3) defined on the second component housing (10), lockingly engage with the plurality of grooves (G1, G2, G3) provided on the first component housing (5) to form the assembly (100). Simultaneously, the locking devices (L1, L2) of the second component (2) are configured to lockingly engage with the wall (W) of the first component (1), as seen in FIGS. 10 and 11. In fact, during formation of the seal assembly (100) in yet another embodiment of the present invention, the locking devices (L1, L2)

can also be configured on the second component housing (10) to lockingly engage with walls or edges provided adjoining to the vertical opening (1A) also.

The plurality of corrugated substrate lines (D) and substrate lines (D') are subjected to a permanent fixing process, such that the corrugated substrate lines (D) and substrate lines (D') melt and fuse with the inner surfaces of the first component housing (5). In a preferred embodiment of the present invention, the corrugated substrate lines (D) and the substrate lines (D') can be defined in any shapes and sizes. The function of the corrugated substrate lines (D) and the substrate lines (D') is to provide a filler material or a weld substrate to permanently fuse and fix the first component housing (5) with the second component housing (10), during the permanent fixing process such as ultrasonic welding. The permanent fixing process in a preferred embodiment of the present invention is ultrasound welding. However, it shall be understood by a person skilled in the art that permanent fixing processes such as welding, brazing, soldering, or any other favourable permanent fixing process may be used to fuse the first component housing (5) with the second component housing (10). It shall be further clear to a person skilled in the art that the filler material or substrate can be the solder material, when soldering is used to lockingly fix the first component housing (5) with the second component housing (10). In a preferred embodiment of the present invention, the corrugated substrate lines (D) melt and fuse with an upper inner surface (UI) of the first component housing (5), during ultrasonic welding. Similarly, the substrate lines (D') melt and fuse with a lower inner surface (LI) of the first component housing (5), also during ultrasonic welding. Therefore, this permanent fixing of the first component housing (5) with the second component housing (10) creates a tamper proof seal assembly (100).

As seen in FIGS. 10 and 11, the seal assembly (100) as per a preferable embodiment of the present invention is configured to have the two first component apertures (5A, 5B), the second component aperture (10A), the second component opening (2A) and the gap (9G), all in a coaxial assembly, thereby defining a channel (9C). Effectively, the tail element (3) passes through the channel (9C) such that the plurality of teeth (9T) lockingly secure the tail element (3), and therefore secures all the articles held by the tail element, as per an embodiment of the present invention.

As per a preferred embodiment of the present invention, all elements/features are molded on the first component (1) and the second component (2) of the seal assembly (100). Therefore, the first component (1) and the second component (2) each, along with all their respective elements/features, is a single piece molded entity in a preferred embodiment of the present invention. However, it shall be clear to a person skilled in the art that the various elements/features provided on the first component (1) and the second component (2) can be separately attachable and detachable to form the first component (1) and the second component (2) as disclosed herein.

As seen from the various embodiments described through the accompanying FIGS. 1-11, the present product is assembled and locked by, (a) the plurality of protrusions (P1, P2, P3) lockingly engaging with the plurality of grooves (G1, G2, G3); (b) the locking devices (L1, L2) lockingly engaging with the outer wall (W) of the first component housing (1); and (c) by ultrasonically welding the second component housing (10) with the first component housing (5). In view of these locking arrangement, also known as multi-point locking arrangements, tampering of the seal assembly (100) is difficult. Further, any attempt at tampering the herein disclosed seal assembly (100) or any of its embodiments, can be detected by plain visual inspection. Still further, reassembling the seal assembly (100) as per an embodiment of the present invention, after tampering the same, is not easy. Therefore, the security seal (100) provides tamper proof security to the articles that are secured by the same.

The foregoing description of the present invention has been set merely to illustrate the product and is not intended to be limiting. Since modifications of the disclosed embodiments incorporating the substance of the product may occur to a person skilled in the art, the invention should be construed to include everything within the scope of the disclosure. Further, FIGS. 1-11 are intended to be illustrative, not limiting. Although, the product is generally described in the context of these embodiments, it should be understood that it is not intended to limit the scope of the present invention to these particular embodiments as shown in the FIGS. 1-11.

The invention claimed is:

1. A seal assembly comprising:

a first component housing molded on a first component, the first component housing having at least two oppositely facing vertical openings, wherein a plurality of grooves are provided on a lower surface of the first component housing; and a second component housing molded on a second component, the second component housing is adapted to be connected to a tail element emerging from the second component housing, wherein:

a plurality of protrusions are provided on a lower surface of the second component housing;

at least one locking device extends from the second component housing; and the tail element slides through the at least two oppositely facing vertical openings to urge the second component housing inside the first component housing to simultaneously allow the plurality of protrusions configured to lockingly engage with the plurality of grooves along with the at least one locking device configured to engage with a wall adjoining the vertical openings.

2. The seal assembly as claimed in claim 1, wherein:

the lower surface of the first component defines a weld substrate lines, and the weld substrate lines fixes with a lower inner surface of the first component.

3. The seal assembly as claimed in claim 1, wherein:

the second component defines a plurality of corrugated weld substrate lines on an upper surface of the second component, and the plurality of corrugated weld substrate lines fixes with an upper inner surface of the first component.

4. The seal assembly as claimed in claim 3, wherein the weld substrate lines and the plurality of corrugated weld substrate lines are respectively fixed with the lower inner surface and the upper inner surface, by welding.

5. The seal assembly as claimed in claim 1, wherein:

the second component housing accommodates a metal insert that is placed over a seat, and the seat is provided inside at least one second component opening of the second component housing.

6. The seal assembly as claimed in claim 5, wherein:

the metal insert defines at least two projections, and each projection has an edge defining a plurality of teeth.

7. The seal assembly as claimed in claim 1, wherein:

the first component housing has a plurality of first component apertures, and each first component aperture is coaxially defined on an upper face and the lower face of the first component housing.

8. The seal assembly as claimed in claim 1, wherein:

the second component housing has one or more second component apertures defined on the upper surface, and at least one second component opening is provided on the lower surface of the second component.

9. The seal assembly as claimed in claim 5, wherein at least two projections define a gap between each of the edge of the at least two projections.

10. The seal assembly as claimed in claim 8, wherein the plurality of first component apertures, the one or more second component apertures, and the at least one second component opening are coaxially assembled in the assembly to define a channel.

11. The seal assembly as claimed in claim 10, wherein the tail element is passed through the channel to lockingly secure the tail element by a plurality of teeth.

12. The seal assembly as claimed in claim 1, wherein:

the tail element has a plurality of spikes, and the plurality of spikes are defined at predetermined distances from the second component housing.

* * * * *